US006126411A

United States Patent [19]

Flanigan et al.

[11] Patent Number: 6,126,411

[45] Date of Patent: Oct. 3, 2000

[54] SIPHON PREVENTION IN A COMPRESSOR LUBRICATION SYSTEM

[75] Inventors: Paul J. Flanigan, Cicero; Curtis E. Johns, Fayetteville, both of N.Y.

[73] Assignee: Carrier Corporation, Syracuse, N.Y.

[21] Appl. No.: 09/146,854

[22] Filed: Sep. 3, 1998

[51] Int. Cl.[7] ..... F04B 23/00

[52] U.S. Cl. ..... 417/313; 277/345; 184/26

[58] Field of Search ..... 417/313; 277/345; 184/26, 24

[56] References Cited

U.S. PATENT DOCUMENTS

| | | | |
|---|---|---|---|
| 3,617,155 | 11/1971 | Hansen et al. | 417/310 |
| 4,071,254 | 1/1978 | Raimondi et al. | 277/3 |
| 5,176,505 | 1/1993 | Horii et al. | 417/295 |
| 5,772,214 | 6/1998 | Stark | 277/345 |

FOREIGN PATENT DOCUMENTS

| | | |
|---|---|---|
| 61123780 | 6/1986 | Japan . |

*Primary Examiner*—Henry C. Yuen
*Assistant Examiner*—Arnold Castro

[57] ABSTRACT

In open drive refrigerant compressors, the location where the shaft extends through the casing provides a potential location for leakage of refrigerant. Where a shaft seal is used which requires an oil seal, the draining of oil from the shaft seal cavity, upon stopping the compressor, is prevented by placing a check valve downstream of the shaft seal cavity which forms a part of the oil distribution system. An optional check valve may be located upstream of the shaft seal cavity.

4 Claims, 2 Drawing Sheets

10
12
12-1
12-2
12-3
12-4
20
20-1
20-2
21
26
30
31
32
34
38
40
42
44
50
51
52
54
70
71
72
74

SIPHON PREVENTION IN A COMPRESSOR LUBRICATION SYSTEM

BACKGROUND OF THE INVENTION

Positive displacement compressors include structure for circulating lubricant to parts requiring lubrication. Commonly the lubricant is pumped to the structure requiring lubrication and subsequently drains by gravity to the oil sump. In open drive systems the shaft extends through the housing with the oil in the shaft seal cavity coacting with the shaft seal to provide a fluid seal. In the case of refrigerant compressors, refrigerant is present in the oil due to an affinity between oil and refrigerant. Accordingly, if the seal is compromised by the draining of oil from the shaft seal cavity or due to dilution of the oil due to condensing refrigerant, refrigerant may leak through the seal into the atmosphere.

SUMMARY OF THE INVENTION

A check valve is placed in the oil distribution path downstream of the shaft seal cavity. When the compressor is stopped, the oil in the shaft seal cavity upstream of the check valve acts as a column of trapped fluid, much as a soda straw filled with liquid with the top opening sealed by a finger. Accordingly, the column of trapped fluid tends to remain in place. Additionally, a second check valve may be located upstream of the shaft seal cavity to prevent oil from draining from the shaft seal cavity. Thus, most, if not all, of the trapped lubricant remains in place in the shaft seal cavity on shut down and serves to seal the shaft seal.

It is an object of this invention to prevent oil from siphoning and/or draining out of the shaft seal cavity of a compressor.

It is another object of this invention to maintain the shaft seal of an open drive compressor. These objects and others as will become apparent hereinafter, are accomplished by the present invention.

Basically, oil is trapped, upon compressor shut down, in the shaft seal cavity portion of the oil distribution system by a check valve located downstream of the shaft seal cavity. Additionally, a second check valve may be located in the oil distribution system upstream of the shaft seal cavity.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
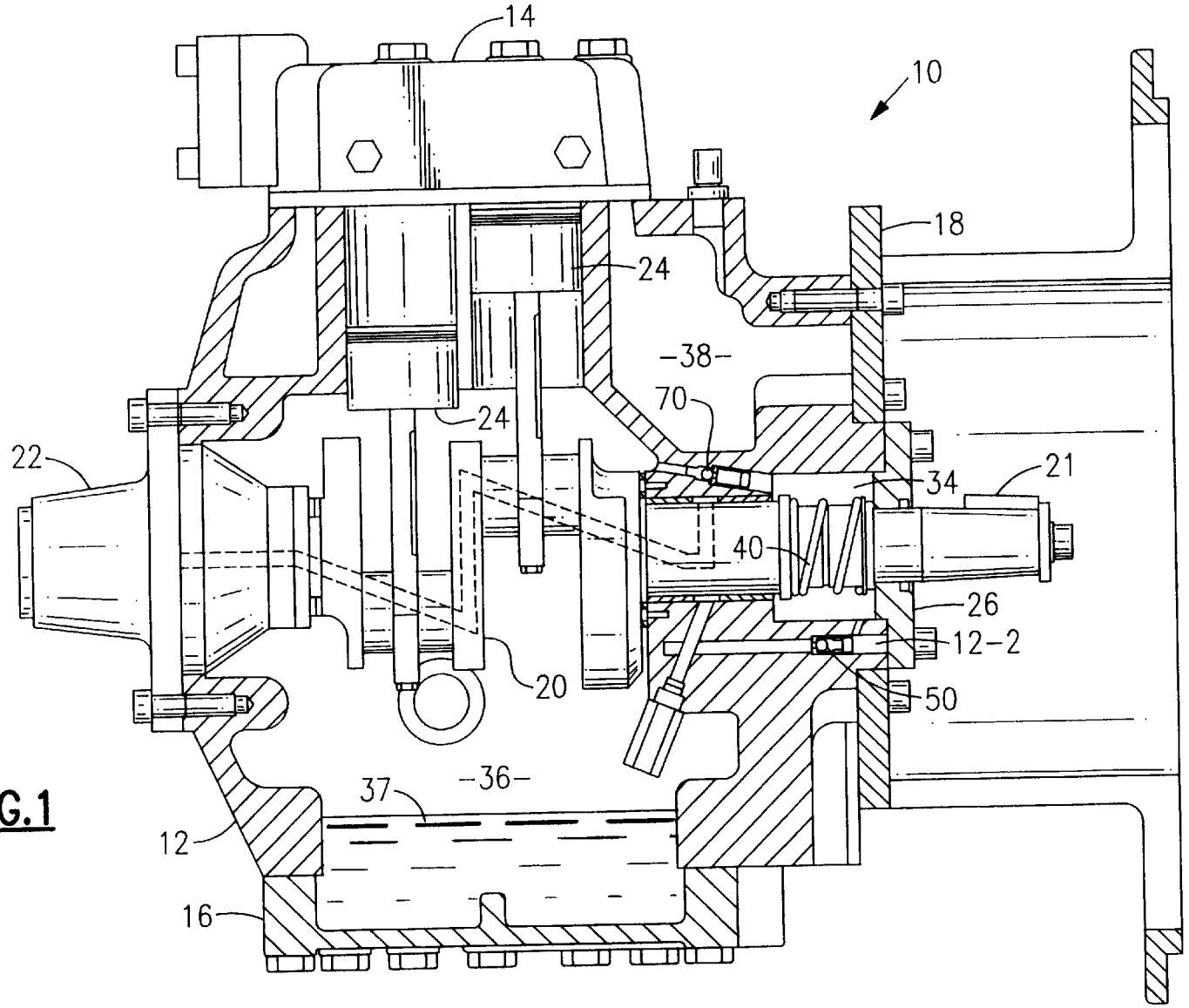
FIG. 1 is a partially sectioned view of an open drive reciprocating compressor employing the present invention.
Figures 2, 3, 4:
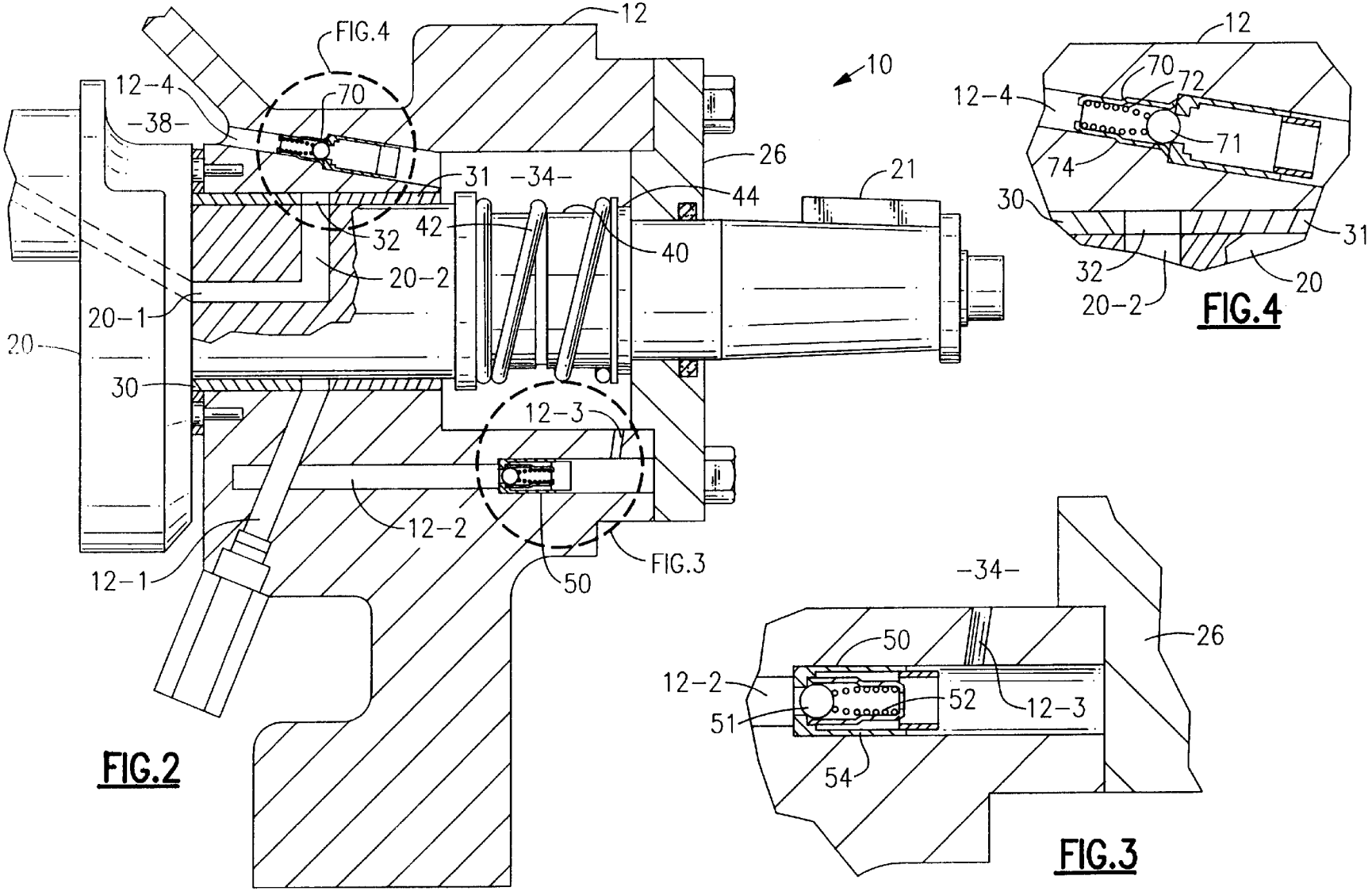
FIG. 2 is a partially cutaway and partially sectioned view of a portion of the FIG. 1 structure.
FIG. 3 is an enlarged sectional view of a first valve illustrated in FIGS. 1 and 2.
FIG. 4 is an enlarged sectional view of a second valve illustrated in FIGS. 1 and 2.

In FIGS. 1 and 2, the numeral 10 generally designates an open drive reciprocating compressor that relies on oil flooding of the shaft seal cavity 34 to maintain a seal. As is conventional, compressor 10 includes a crankcase 12, one or more cylinder heads 14, and a bottom cover 16. Crankcase or casing 12 is divided into an oil sump 36 containing gaseous refrigerant with liquid oil 37 located therein, and suction plenum 38. The discharge plenum is located in cylinder heads 14. Because compressor 10 is an open drive compressor, a mounting flange 18 is suitably secured to crankcase 12 and serves to permit connecting compressor 10 to a diesel engine, or the like (not illustrated). Crankshaft 20 is operatively connected to the diesel engine, or the like, via key 21 and drives oil pump 22 and pistons 24. A series of interconnecting bores extend through crankshaft 20 and feed radial distribution passages of which only bore 20-1 and radial passage 20-2 are illustrated in FIG. 2.

Crankshaft 20 is supported by bearings 30 and 31 which are axially separated to provide an annular chamber 32 which is supplied with oil via radial passage 20-2 and forms part of the oil distribution path. A series of interconnecting bores 12-1, 12-2 and 12-3 formed in crankcase 12 define a fluid path between annular chamber 32 and shaft seal cavity 34. Bore 12-4 connects the upper portion of shaft seal cavity 34 with oil sump 36. Valve 50 is located in bore 12-2 and valve 70 is located in bore 12-4. Shaft seal 40 is located in shaft seal cavity 34 in a surrounding engagement with crankshaft 20 and includes spring 42 which biases carbon ring 44 into sealing engagement with cover plate 26.

Referring specifically to FIG. 3, valve 50 is a spring biased ball check valve. Spring 52 normally biases ball element 51 onto its seat blocking flow through valve 50 and therefore through bore 12-2 in which valve 50 is located. A shoulder in bore 12-2 serves to properly locate valve 50 in bore 12-2 with valve housing or cage 54 coacting with bore 12-2 and the shoulder to provide a tight fit such that all flow must pass through valve 50 in passing through bore 12-2.

Referring specifically to FIG. 4, valve 70 is also a spring biased ball check valve. Spring 72 normally biases ball element 71 onto its seat blocking flow through valve 70 and therefore through bore 12-4 in which valve 70 is located. One, or more, shoulders in bore 12-4 serve to properly locate valve 70 in bore 12-4 with valve housing or cage 74 coacting with bore 12-4 and the shoulders to provide a tight fit such that all flow must pass through valve 70 in passing through bore 12-4.

In operation, the diesel or the like (not illustrated) drives crankshaft 20 through key 21 causing crankshaft 20 to rotate. Rotation of crankshaft 20 causes the reciprocation of pistons 24 as well as the driving of oil pump 22. Oil pump 22 draws oil 37 from oil sump 36 and delivers the oil under pressure to a series of interconnecting bores extending through crankshaft which feed radial distribution passages. Bore 20-1 is in fluid communication with the oil pump 22 through the interconnecting bores in crankshaft 20 such that pressurized oil supplied by oil pump 22 serially passes through bore 20-1, radial passage 20-2, annular chamber 32, bores 12-1, 12-2 and 12-3, shaft seal cavity 34, and bore 12-4 back into oil sump 36. The oil distribution path just described is generally conventional. The present invention adds valve 70 which is located in bore 12-4 and, optionally, valve 50 which is located in bore 12-3. Valves 50 and 70 each have a spring bias on the order of six pounds tending to bias them closed.

Because oil pump 22 is a positive displacement pump, the oil readily flows past check valve 50, if present, into shaft seal cavity 34 which remains essentially filled with oil according to the teachings of the present invention. Oil flows from shaft seal cavity 34, through bore 12-4 past check valve 70 to oil sump 36. When the compressor 10 is stopped, check valve 70 will close when the pressure differential across valve 70 cannot overcome the spring bias acting thereon. With valve 70 closed, the portion of bore 12-4 upstream of valve 70, shaft seal cavity 34, bore 12-3 and at least the portion of bore 12-2 downstream of valve 50, if present, and otherwise all of bore 12-2, will constitute a column of trapped fluid. Gaseous refrigerant may separate from the oil where the oil and refrigerant are miscible but the gaseous refrigerant would collect at the top of shaft seal cavity 34. If check valve 50 is present and there is a pressure build up greater than the spring bias pressure due to the gaseous refrigerant, valve 70 could open thereby relieving the pressure. When the pressure is relieved, valve 70 will close to maintain the column of trapped fluid.

The primary concern is to keep sufficient oil in shaft seal cavity 34 to provide a fluid seal and thereby prevent the leakage of gaseous refrigerant. Check valve 50 is not necessary, but traps the downstream oil in the event that valve 70 leaks or is otherwise ineffective to create a column of trapped fluid, including shaft seal cavity 34, upon shut down.

Although a preferred embodiment of the present invention has been illustrated and described, other changes will occur to those skilled in the art. For example, although a reciprocating compressor has been described, the present invention is applicable to other positive displacement open drive compressors such as screw compressors. It is therefore intended that the scope of the present invention is to be limited only by the scope of the appended claims.

What is claimed is:

1. In an open drive compressor having a casing, an oil sump, a shaft seal cavity, a shaft extending through said seal cavity and said casing, a shaft seal in said seal cavity providing a seal where said shaft extends through said casing, an oil distribution means for supplying oil from said sump to a path including a passage for supplying oil to said seal cavity and a passage for delivering oil from said seal cavity back to said sump, the improvement comprising:

a check valve coacting with said passage for delivering oil from said cavity to only permit flow from said cavity into said passage for delivering oil while preventing reverse flow by causing a column of fluid to be trapped upon compressor stoppage.

2. The compressor of claim 1 wherein said passage for delivering oil from said seal cavity begins at an upper portion of said seal cavity.

3. The compressor of claim 1 wherein when said check valve coacting with said passage for delivering oil is closed said check valve coacting with said passage for delivering oil acts to trap oil in said passage for delivering oil upstream of said check valve coacting with said passage for delivering oil and in said seal cavity whereby an oil seal is maintained in said seal cavity.

4. The compressor of claim 1 further including a second check valve located in said passage for supplying oil to said seal cavity.

* * * * *